US005914065A

United States Patent [19]

Alavi

[11] Patent Number: 5,914,065

[45] **Date of Patent: *Jun. 22, 1999**

[54] APPARATUS AND METHOD FOR HEATING A FLUID BY INDUCTION HEATING

[76] Inventor: Kamal Alavi, 152 April Point North, Montgomery, Tex. 77356

[ * ] Notice: This patent issued on a continued prosecution application filed under 37 CFR 1.53(d), and is subject to the twenty year patent term provisions of 35 U.S.C. 154(a)(2).

[21] Appl. No.: 08/619,940

[22] Filed: Mar. 18, 1996

[51] Int. Cl.[6] ..... H05B 6/10

[52] U.S. Cl. ..... 219/631; 219/630; 219/672

[58] Field of Search ..... 219/631, 628, 219/629, 630, 672

[56] References Cited

U.S. PATENT DOCUMENTS

| | | | |
|---|---|---|---|
| 3,014,116 | 12/1961 | MacArthur | 219/631 |
| 3,821,508 | 6/1974 | Hagerty | 219/631 |
| 4,217,475 | 8/1980 | Hagerty | 219/631 |
| 4,421,967 | 12/1983 | Birgel et al. | 219/631 |
| 4,486,638 | 12/1984 | De Benetot | 219/631 |
| 4,511,777 | 4/1985 | Gerard | 219/631 |
| 4,600,821 | 7/1986 | Fichtner et al. | 219/631 |
| 4,614,853 | 9/1986 | Gerard et al. | 219/631 |
| 5,012,060 | 4/1991 | Gerard et al. | 219/631 |

FOREIGN PATENT DOCUMENTS

| | | | |
|---|---|---|---|
| 1106440 | 5/1961 | Denmark . | |
| 1169603 | 5/1964 | Denmark . | |
| 0087727 | 9/1983 | European Pat. Off. . | |
| 446348 | 1/1950 | Italy | 219/631 |
| 662691 | 10/1987 | Switzerland . | |
| 2111360 | 6/1983 | United Kingdom . | |

*Primary Examiner*—Philip H. Leung
*Attorney, Agent, or Firm*—Madan & Morris, P.C.

[57] ABSTRACT

In a heating apparatus for the heating of a solid or fluid medium, several permanent magnets are arranged on the periphery of a rotor which produce a magnetic field in whose region an electrically-conducting medium is arranged. The magnetic field from the permanent magnets is radiated approximately radially. By rotation of the rotor, a relative motion arises between the permanent magnets and the electrically-conducting medium, and eddy currents are effected within the medium, thereby causing heating of the same. Electrically-conductive water can be provided as the medium to be heated. In this embodiment electrically-conductive water is fed through a helical conducting coil, with an inlet and outlet side arranged around the rotor in proximity thereto, and is connected to a line which feeds to a user from the outlet side and back to the inlet side in a closed cycle. With this heating apparatus, heat is transferred to the medium with an improved efficiency. In a second embodiment, permanent magnets are arranged on opposing rotating discs so that they produce a magnetic field between the discs. An electrically-conductive material to be heated is placed between the disks, within the magnetic field. In a third embodiment, permanent magnets are arranged on opposing sides of a centrifugal pump having an electrically-conductive impeller. The discs are stationary. Heat is generated in the impeller when it is rotated. The impeller provides both the heating and the flow of the heated fluid.

7 Claims, 5 Drawing Sheets

APPARATUS AND METHOD FOR HEATING A FLUID BY INDUCTION HEATING

CROSS-REFERENCES TO RELATED APPLICATIONS

Under 35 U.S.C. § 119, this inventor claims the benefit of a patent application filed in Switzerland on Mar. 17, 1995, having the application number 00 763/95-6.

BACKGROUND OF THE INVENTION

1. Field of the Invention

This invention relates generally to the generation of heat using eddy currents and more particularly to apparatus and method for generating heat utilizing permanent magnets.

2. Description of the Related Art

Heat can be generated in an electrically-conductive material by subjecting it to a magnetic field, where either the conductive material or the magnetic field is in motion. A varying or moving magnetic field produces eddy currents in a conductive material placed in the magnetic field. A changing magnetic field causes rapid movement of the electrons in the conductive material, which generates heat. The use of electromagnetism in induction heating is a relatively developed art that Unlike induction heating where the magnetic field is generated, the magnetic field is already present an permanent magnet heating. Induction heating typically uses a varying frequency alternating electric current rather than a standard, constant-frequency alternating current (AC) supplied by a utility company. Permanent magnet heating does not require a variable frequency AC electric field.

Permanent magnet heating is attractive because high power densities can be generated directly in the body and/or material to be heated. Thus, it is highly efficient. Variables that effect the amount of heat generated include: the strength of the magnetic field, the number of magnets, the spacing between the permanent magnets, the relative speed between the permanent magnets and the material to be heated. The greater the magnetic field strength the greater the heat generated in an adjacent conductive material. The greater the relative speed the greater the heat generated, as this provides a greater frequency of field change. Other factors that effect the amount of heat generated are the resistivity, permeability, size, and shape of the body to be heated, and magnet size and shape.

The material to be heated is referred to as the conductive material, a solid and/or fluid. Resistivity and permeability vary substantially in conductive materials, which may be classified by their magnetic properties as diamagnetic, paramagnetic, and ferromagnetic materials. Diamagnetic materials oppose the establishment of a magnetic field and include copper, gold, and silver. Paramagnetic materials can be weakly magnetized by a strong magnetic field and include aluminum and platinum. Ferromagnetic materials are easily magnetized by a strong magnetic field and include iron, nickel, steel, some rare earth metals, and alloys thereof. While ferromagnetic materials provide the highest efficiency for induction heating, it is believed that diamagnetic materials provide the highest efficiency for permanent magnet heating because permanent magnets magnetize ferromagnetic material, causing a loss in the strength of the magnetic field of the permanent magnet.

The present invention pertains to a heating apparatus for the heating of a medium with several adjacently arranged permanent magnets which produce a magnetic field inside of which an electrically conducting material is placed. A linear and/or rotating relative motion is produced between the material and the permanent magnets whereby the material is heated.

Swiss patent application CH-PS 662 691 shows a turbomolecular pump wherein a rotor is arranged in a high-vacuum side of the interior of a housing. Attached to the rotor are discs which cooperate with stator discs fastened to the housing. In order to accelerate the desorption of the high-vacuum side surfaces, the construction parts with these surfaces are heated. To accomplish this, the rotor is heated by eddy currents, which arise from the interaction of the rotor's own rotation with a magnetic field whose field lines run perpendicular to the rotor axis. The magnetic field is produced by a permanent or electro-magnet, fastened outside the housing, the magnetic field lines of which run perpendicular to the rotor axis. With this heating arrangement, only a limited heating capability is possible.

Danish patent application DE-A-1 106 440 shows a rotating bell made of ferromagnetic material arranged at the base of a steam-producing vessel constructed of good conducting material. On the outside surface of this bell, rim-shaped permanent magnets are placed which radiate a magnetic field in an alternating pole fashion. The vessel surrounding the bell has a ring encompassing the magnets at a small distance which is likewise made of ferromagnetic material, for example soft iron. By rotating the bell, the permanent magnets located on its circumference effect a heating of the surrounding vessel and the ring due to the eddy currents which arise. The latter conducts the heat to the water present in the vessel. The heat transferred with this apparatus does not result in optimal heat transfer to the water medium to be heated.

U.S. Pat. No. 4,421,967, issued to Birgel et al. discloses a windmill electric heater that converts wind energy to heat energy. A windmill drives a rotor of an eddy current heater. Magnetic fields are provided at an air gap between the rotor and a stator of the eddy current heater. Rotation of the rotor with respect to the stator causes eddy currents, and therefore heat, to be generated in the rotor. The heat generated in the rotor is drawn off for beneficial use such as in heating a house. Excitation of the magnetic fields (and therefore the amount of heat generated) is controlled as a function of sensed parameters such as wind velocity, ambient temperature of the surroundings to be heated and temperature of the eddy current heater.

U.S. Pat. No. 4,511,777, issued to Gérard, discloses a rotary magnet thermal generator system having an array of magnets in an alternating disposition coaxially disposed about and parallel with the shaft of a motor driving the rotary array and having a copper heat absorber and a ferromagnetic plate fixed on a face of the heat absorber. The device includes a plurality of heat sink plates extending beyond the ferro-magnet plate into a plenum through a respective plurality of close-fitting apertures.

U.S. Pat. No. 4,614,853, issued to Gérard et al., discloses a magnetic thermal generator that has axially aligned, spaced-apart shafts, each with an electric motor at the outer end and on each inner end a permanent cylindrical magnet rotor with alternate north-pole and south-pole disposition of magnets parallel to each other in a circle about the shaft axis. In the spacing between the inner ends of the shafts a boiler is axially affixed. The boiler is of steel, is cylindrical in cross-sectional shape, and has at each end a steel disk-shaped end closure on the outside of which is bolted a copper disk of the same size. Fixed to the copper disk and extending hermetically through the end closure are a plurality of copper heat sinks, with axially alternative larger and smaller diameters; preferably the copper heat sinks from the respective ends are coaxially disposed and terminate within the boiler adjacent to each other but not touching. A steam dome protrudes from the top of the boiler and water inlet, water vent to the steam dome and steam exhaust are provided for water to be heated and passed transversely through the boiler into the steam dome.

Devices disclosed in the U.S. Pat. Nos. 4,511,777 and 4,614,853 share a similar design and several inefficiencies. In such devices part of the permanent magnets' energy is used to magnetize ferromagnetic material, causing a loss in the permanent magnets' stored energy. A ferromagnetic plate adjacent a plate to be heated, but away from the magnets, weakens the magnets by imparting a dynamic load on the magnets, assuming the magnetic field reaches that far. Further, the thermal design is poor in that the copper plate to be heated is too large, making the thermal mass too large and resulting in wasted heat.

U.S. Pat. No. 5,012,060, issued to Gérard et al. discloses a permanent magnet thermal generator having at least one stationary permanent magnet and a rotatable rotor assembly for producing and absorbing heat from the magnetic flux from the permanent magnet as the rotatable rotor is rotated. The rotor assembly serves as a heat absorber, an impeller to move a heat transfer fluid around the rotor assembly and to transfer heat to the heat transfer fluid that moves around the rotating rotor. In one embodiment the strength of the permanent magnet is varied by adding or subtracting magnets and in another embodiment the rotor assembly is constructed in such manner that the heat transfer fluid is recycled around the rotor assembly. Furnace, steam boiler and refrigeration systems incorporating a permanent magnet thermal generator are also set forth. The device described in this patent has an inefficient magnet configuration and a poor thermal design.

The present invention addresses many problems with the presently known systems and provides permanent magnet heating apparatuses that are efficient and relatively easy to manufacture. Features and characteristics of the present invention include: a shape that links magnetic fields enhancing field strength; a design for holding magnets in place while under rotational forces; a design for a conductive material that enhances heat transfer to a fluid; a design for simultaneously heating and pumping a fluid; and/or a design for avoiding corrosion of magnets. The present invention is useful in a variety of applications.

SUMMARY OF THE INVENTION

In a preferred embodiment, permanent magnets are arranged in axial rows a body aligned concentrically with and attached to a shaft. Adjacent rows of magnets have opposite, attracting poles so that a magnetic field emanates around the magnets. A suitable conduit (heat exchanger) is placed proximate to the permanent magnets and in the magnetic field. The magnets are rotated by a prime mover, preferably an electrical driver, while the conduit is stationary. Rotation of the magnets creates a rotating magnetic field, which produces eddy currents in the conduit and/or a fluid therein. The eddy currents generate heat, which is absorbed by the fluid within the conduit. The magnets are preferably arranged on the outer surface of the body with the conduit wrapped outside of the magnets. The magnets, however, may be placed on the inside surface of the body with a conduit placed in close proximity to the magnets inside the body.

In another embodiment, permanent magnets are arranged on opposing rotating discs so that they produce a magnetic field between the discs. An electrically-conductive material to be heated is placed between the disks, within the magnetic field. The discs are mounted on a shaft and rotated by a driver. Yet, in another embodiment, permanent magnets are arranged on opposing sides of a pump to produce a magnetic field within the pump. The pump contains an electrically-conductive impeller. During operation, the magnets are stationary, while the impeller is rotated. As the impeller is rotated, eddy currents are set up in the impeller, which heats the impeller. A suitable fluid at a pump inlet is both pumped and heated by the apparatus as the fluid contacts the impeller and absorbs heat therefrom. Alternatively, permanent magnets may be arranged along one face of the pump housing. The magnets are arranged so that adjacent magnets have opposite, attracting poles.

In another embodiment, a fluid is both heated and compressed in an axial compressor having electrically-conductive rotors and magnetic stators in close proximity to the rotors. The rotors move through a magnetic field as they pass by the magnetic stators, thus generating eddy currents in the rotors which heats the rotors. The fluid absorbs heat from the rotors as it is compressed.

The heating apparatus of the present invention achieves an improved heat transfer and thereby an increased effectiveness of heating a medium compared to known prior art apparatus. This is partly accomplished by the use of an electrically-conducting fluid medium that is circulated through a conduit placed in the varying magnetic field produced by the permanent magnets and which is heated by the eddy currents produced in the conduit and the fluid medium.

In a preferred embodiment, the permanent magnets are arranged on the periphery of a rotor. The magnetic field radiates substantially radially from the magnets. The fluid medium is circulated inside or outside the rotor. The motion relative to the medium is achieved by turning the rotor and, thus, the permanent magnets. In an alternative embodiment, the permanent magnets are arranged on the front face of a rotating disc so as to produce a magnetic field radiating in the direction of the disc rotating axis. The fluid medium is placed in proximity to at least one face of the disc.

Examples of the more important features of the invention thus have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals and wherein:

FIG. 3 shows a schematic cross-section of an alternative embodiment of the heating apparatus of the present invention.

DETAILED DESCRIPTION OF THE PREFERRED EMBODIMENTS

Figure 1:
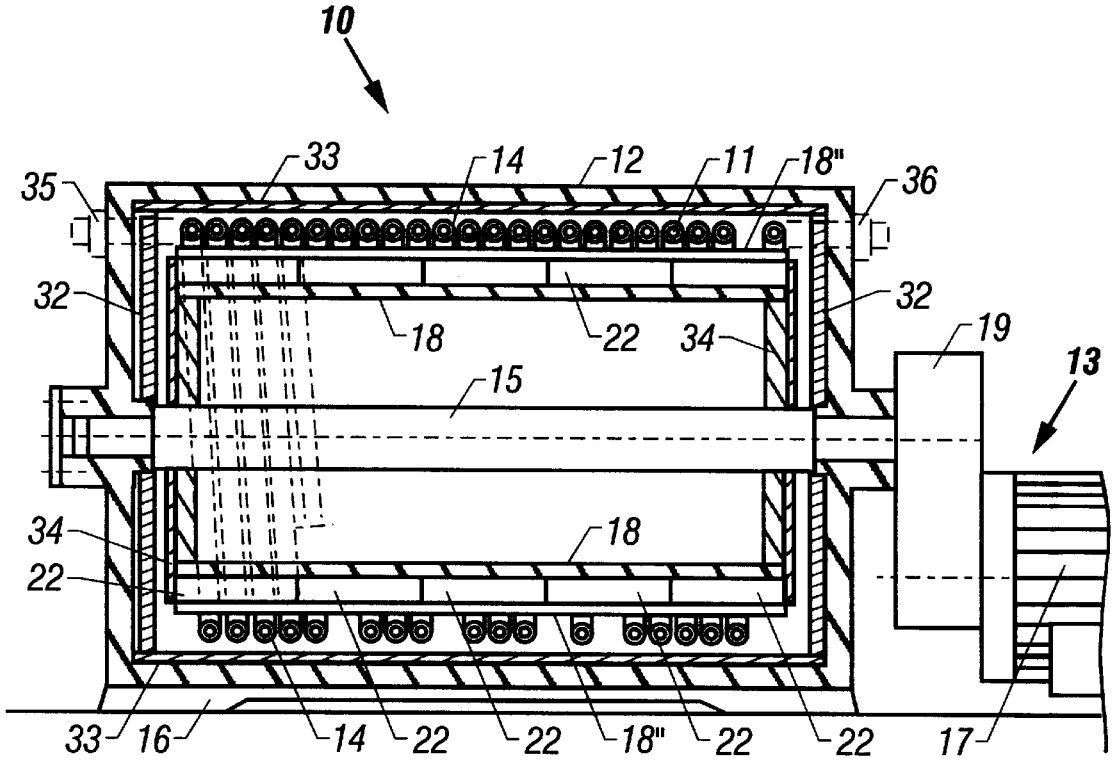
FIG. 1 shows a schematic elevational view of a segment of an embodiment of the heating apparatus according to the present invention.
Figure 2:
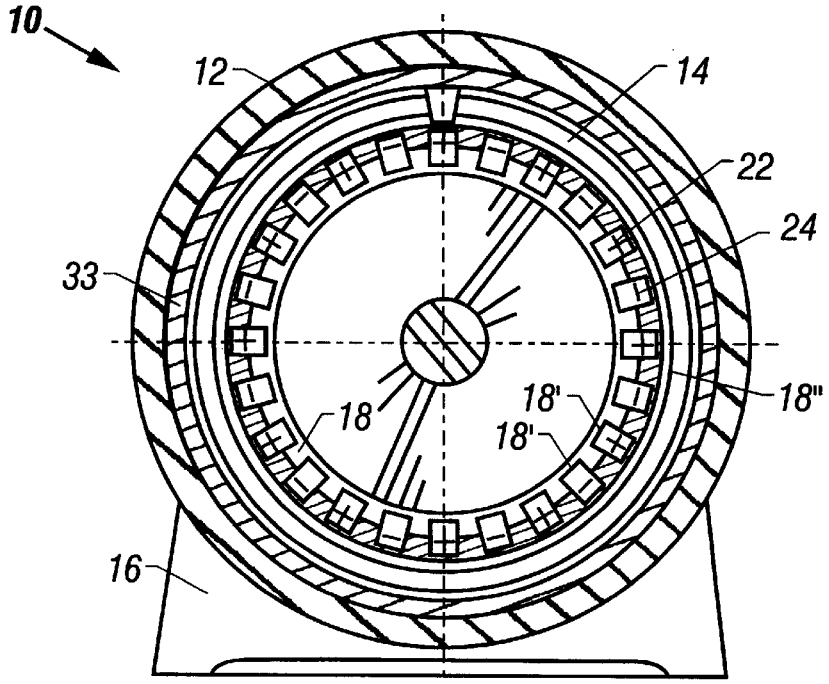
FIG. 2 shows a cross-sectional view of the heating apparatus shown in FIG. 1.

A preferred embodiment of a permanent magnet heating apparatus 10 is shown in a partial sectional side view in FIG. 1 and in a cross-sectional view in FIG. 2. A shaft or rotor 15 is supported in a housing 12 and rotated by a drive unit 13. The shaft 15 is rotated through a gear or pulley arrangement 19 by an electric motor 17. Circular flanges 34 are attached on opposing ends to the shaft 15 within the housing 12. A body, preferably a cylindrical drum, 18 is secured to the flanges 34 concentric with the shaft 15. The outer surface of the drum 18 has recessed channels 18' running parallel (axially) with the shaft 15 about the perimeter of the drum 18. Permanent magnets 22 and 24 are secured in the channels 18' by one or more fastening rings 18". A conducting coil 14 containing a fluid medium 11 (the working fluid) is wrapped around the permanent magnets 22 and 24.

The housing 12 has a cylindrical outside form and has a pedestal 16 with which it can be set on the ground or the like and to which it can be secured as needed. The housing 12 preferably includes heat and sound isolation 32 and 33 along its entire inside surface. Additionally, a lead foil to shield the electromagnetic field from the outside environment may be placed inside or outside the housing 12. The housing 12 may further be covered on the inside with a non-magnetic steel cladding. The housing 12 is constructed in a manner that enables mounting of the magnet assembly or the rotor inside the housing 12. The drum 18 is fastened to the flange 34 on both sides and each flange is held securely to the shaft 15. The rotor is disposed turnably inside the housing 12 and coupled to the drive unit 13. The drive unit is 13 is coupled to a prime mover, such as an electric motor 17 via a gearbox 19. It should be obvious that in place of the drum 18, any suitably-shaped body may be utilized.

A number of permanent magnets 22 and 24 are provided on the periphery of the drum 18 next to each other. A suitable coil 14 is placed helically around the drum 18. A suitable fluid medium 11 (working fluid), preferably an electrically conductive liquid medium is circulated through the coil 14. A relative rotating motion is produced between the permanent magnets 22 and 24 and the medium 11 located within the region of the magnetic fields produced therefrom by rotating the drum 18. When in motion, the permanent magnets 22 and 24 pass by the medium 11 one after the other. Through this relative motion, eddy currents are produced within the medium 11 and/or the conducting coil 14 which cause the fluid medium and the coil to heat. Preferably, several magnets 22 and 24 are placed in their respective recesses 18' along the axial direction of the drum 18. The magnets 22 and 24 are preferably arranged equally spaced on the outside of the drum 18.

In this disclosure, a north pole is designated by (+) and a south pole is designated by (−). In the embodiment of FIGS. 1 and 2 adjacent magnets have opposing poles in the plane radially emanating along the axial direction of the drum 18, i.e., along the length of the drum 18. Each axial magnet, such as magnets 22 or 24 may contain a number of serially placed magnets as shown in FIG 1. If the radially outer surface of an axial magnet or row of magnets, such as magnet 22 is the north pole, then the radially inner surface, i.e., surface toward the drum 18 is the south pole. The outer surface of a particular axial magnet or row of magnets has the same pole (north or south) along its entire length, while the inner radial surface, adjacent the drum 18, has the opposite pole to that of the outer radial surface. Where an axial magnet or row of magnets has a north pole (+) on its outer radial surface, the adjacent magnets on either side will have a south pole (−). Thus, the adjacent axial magnets have alternate opposing poles along the outer and inner surfaces around the circumference of the drum 18.

According to FIG. 2, the permanent magnets 22 and 24 are preferably arranged on the periphery of the drum 18 with minimal separation from one another and with alternating north (+) and south (−) poles. In such a configuration, the magnets 22 and 24 radiate a stationary, loop-shaped magnetic field around the rotor within a distinct bandwidth. The magnetic field causes eddy currents in the medium 11 existing within this bandwidth by way of the existing relative motion. As an example, and not as a limitation FIG. 2 shows five magnets placed side-by-side in contact with one another along the axial direction. The number, length and shape of the magnets 22 and 24 in an axial row depends on the desired heat generation, which depends on the strength and area of the magnetic field, and on the commercial availability of the magnets. A single magnet having the desired length along the axial length of the drum 18 and having a radial pole orientation with respect to the shaft 15, is not believed to be commercially available. Thus, a plurality of serially placed magnets are utilized in the preferred embodiment.

The permanent magnets 22 and 24 are secured on the periphery of the drum 18 parallel to the rotating axis and are held in place by one or more fastening rings 18" around the drum. In the preferred embodiment, the fastening ring 18" is a concentric sleeve preferably fitted tightly over the permanent magnets 22 and 24. The fastening ring should be manufactured from a non-magnetic, non-electrically conductive material, such as a plastic, and may be placed over the magnets after they have been placed around the drum 18. The drum 18 is preferably made of a ferromagnetic material, such as steel.

The permanent magnets 22 and 24 are preferably constructed in rectangular bar form and are arranged next to one another such that the magnetic field produced by each such magnet emanates radially from the drum 18 and returns back to its neighboring opposite pole magnet in a loop. The medium 11 and with it the conducting coil 14, which is fixed in the housing 12, are placed at a predetermined distance from the magnets in a manner that the conducting coil 14 lies within the magnetic field. The distance between the conducting coil 14 and the magnet is relatively small, preferable between 3–20 millimeters.

Figure 2A:
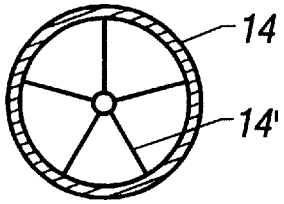
FIG. 2A shows a cross-sectional view of a conducting coil for use in the apparatus of FIG. 1.
Figure 2B:
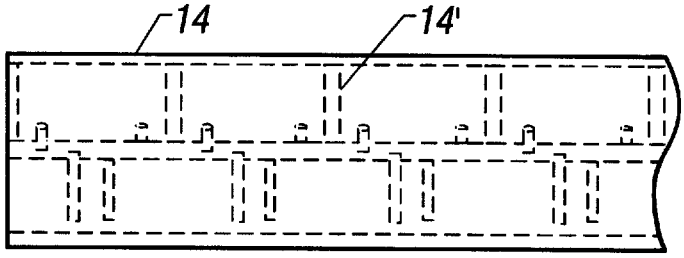

With regards to the conducting coil 14, the distances between neighboring windings of the coil 14 are held as small as practicable. Multiple layers of conducting coil 14 may be used to minimize any gaps between the coil 14. As noted earlier, heat is generated in the conducting coil 14 by eddy currents formed when there is a relative motion between the conducting coil 14 and the magnetic field produced by the magnets 22 and 24. The eddy currents may be formed in the conducting coil 14 and/or the electrically conductive fluid medium 11. A certain amount of turbulence in the fluid medium 11 is desirable as it tends to improve the efficiency of the system. Desired turbulence may be created by inserting a mixing element 14' such as a copper or aluminum twist tape, wire coil, mesh, helical coil, or brush insert into the conducting coil 14, as shown in FIGS. 2A and 2B. Eddy currents will also be generated in such an insert and heat transferred to the fluid medium 11.

As an example, and not as a limitation, the heating apparatus 10 shown in FIGS. 1 and 2, a multitude (between 20 to 50) of substantially identical magnets 22 and 24, with a respective height of about 20 mm and breadth or width of about 10 mm may be arranged equally spaced around the drum 18 having an outside diameter and a length such that there is as small a separation between the adjacent magnets as practicable. The drum 18 rotates preferably with a rotating speed of approximately 3000 revolutions per minute ("rpm"). In principle, a sufficient heating of the medium is reached at a speed of approximately 1000 rpm. As an example, at a speed of approximately 3000 rpm, a drum having an outer diameter of approximately 300 mm will experience a relative velocity of nearly 47 meters/sec.

The permanent magnets 22 and 24 may be made from a suitable conventional material, such as neodymium, strontium-ferrite, strontium-cobalt alloy or another material suitable material for such magnets. It should be obvious that stronger the magnetic field produced per unit of surface in the permanent magnets, greater the heating produced in the medium 11. The conducting coil 14 is preferably made of an electrically conducting material, such as a copper alloy, aluminum or a precious metal, such as platinum or the like. A non-magnetic synthetic material may also be used. The conducting coil 14 is preferably wrapped around the drum many times without gaps left between the loops of the conducting coil 14 so as to make full use of the magnetic field.

A relative rotating motion between the magnets 22 and 24 and the medium may also be produced if the conducting coil 14 as well as the drum 18 are rotated effectively in opposite rotating directions. The conducting coil may also be wound helically on the outside of the drum. Alternatively, the magnets may placed along the inside circumference of the drum 18 and the conducting coil may be placed inside the drum.

It should be noted that the drum 18 and the magnets 22 and 24 may be constructed in any other suitable manner. General practice has shown that the number of permanent magnets should be chosen as large as possible for a maximal load transfer, whereby more impulses per unit of time can be realized at a given rpm of the drum. The drum 12 may be constructed as a multipolar ring, which is provided with an alternating north and south pole distributed on the outside periphery.

Water may be used as the fluid medium 11. Alternatively, a suitable additive such as potassium or a similar compound may be mixed with the water to increase the electrical conductivity of the water. As noted earlier, greater heat transfer is achieved if the water in the coil 14 is in turbulent flow. Thus, the conducting coil 14 preferably has therein inserted the mixing element 14' to increase the turbulence in the fluid medium 11 as shown in FIGS. 2A and 2B.

The rotor 15 is preferably constructed as a flywheel with the drum 18. An advantage is that the energy transferred from the drive unit 13 can be expended with it because the rotor continues to run for a period of time after the power to the motor is turned off.

The fluid medium 11 is fed into the conducting coil 14 through an inlet side and is discharged through an exit side 36. A direct or indirect user line is connected to the exit side 36, which leads back to the entrance side 35 to form a closed loop or cycle. The heating apparatus 10 is suitable especially for the heating of a house, in which the heat conduction is either indirect through the heated body or direct into a storage tank. The stored water, is then heated which is then recycled. The conduction is similar to a boiler or a similar vessel for the heating of the water or other medium.

A control apparatus (not shown) is provided to turn on and off the motor 17 and a pump (not shown) which moves the heated water through the conducting coil 14. The control apparatus preferably contains an emergency stop, which stops the rotor 15 when certain unwanted conditions occur during the operation of the heating apparatus, such as overheating of the magnets or if the temperature of the conducting coil 14 exceeded a predetermined limit or if the fluid medium 11 is not flowing at a desired rate. Adequate fluid flow rate is desirable for the protection of the magnets 22 and 24 because the fluid circulation also cools the magnets 22 and 24. An emergency stop and/or temperature control is also beneficial as high magnet temperatures reduce the magnetic strength of the permanent magnets.

Figure 3:
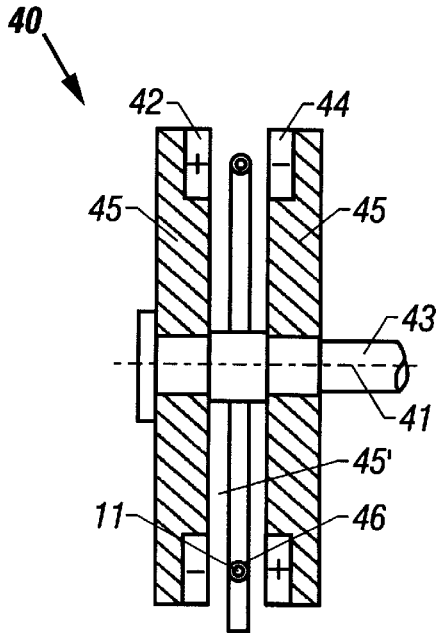
FIG. 3 shows a sectional side view of the conducting coil of FIG. 2A.
Figure 4:
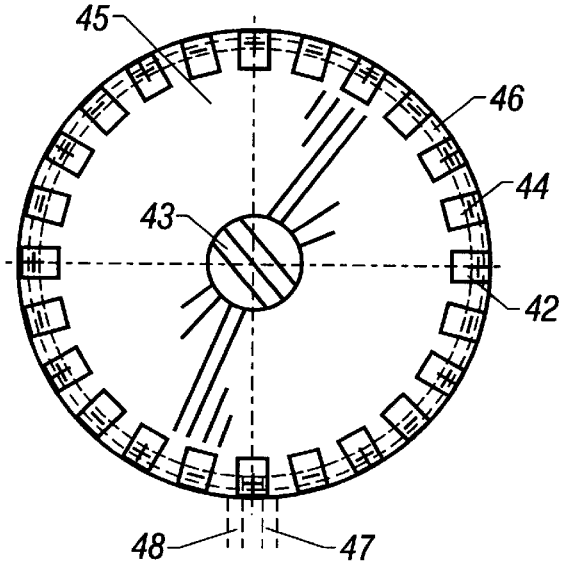
FIG. 4 shows an elevation of a rotating disc with permanent magnets arranged thereon for use in the embodiment of the heating apparatus of FIG. 3.

In a heating apparatus 40 according to FIG. 3 and FIG. 4, a separate rotating disc 45, having permanent magnets 42 and 44 equally distributed on their respective outer faces 45', is arranged on both sides of a circularly arranged conducting coil 46. The conducting coil 46 runs parallel to the rotating discs 45, which are fastened to a drive shaft 43 which is turned by a power means (not shown) such as described earlier with respect to FIG 1. The permanent magnets 42 and 44 are arranged relative to one another such that they respectively radiate a magnetic field in the direction of the conducting coil 46. Both rotating discs 45 are substantially identically constructed and their adjacent magnets are mounted on the outer surface opposite each other with a north pole on one disc facing a south pole on the other disc. A portion of the magnetic field loops around and enters the neighboring oppositely-poled magnets 44 in a radial direction to the disc and a portion of the magnetic field enters perpendicularly to the opposite disc. The conducting coil 46, constructed of electrically-conducting material, and therewith the medium 11, in any case conducting, are placed at a small distance from the faces 45' of the discs 45 so that the conducting coil 46 lies in the magnetic field produced by the magnets 42 and 44. With a turning of the rotating discs 45 connected together over the shaft 43, eddy currents arise in the conducting coil 46 and in the medium 11, which effect a desired heating of the medium 11. The rotating discs 45 should be housed in a housing, not shown further, analogous to those in FIG. 1.

According to FIG. 4, the magnets 42 and 44 are fastened to the outer periphery of a respective rotating disc 45 and a pre-determined number of magnets are arranged per disc in equal proximity to one another. The conducting coil 46 is in addition fed once around the shaft 43 from a radial inlet side 47 and then led to a user from the radial outlet side 48. This heating apparatus 40 is suitable for uses in which a minimal allowance for room is present for it.

It is known that eddy currents in electrically conducting materials arise in time-dependent changes of a produced magnetic field whereby the eddy currents do not leave the conducting material. Therefore, the fluid or gas medium may be made to be electrically conducting as well as the coil 46. In a preferred embodiment, the conducting coil 46 is made from copper and the fluid is a water solution containing approximately 1% potassium hydroxide.

Figure 5:
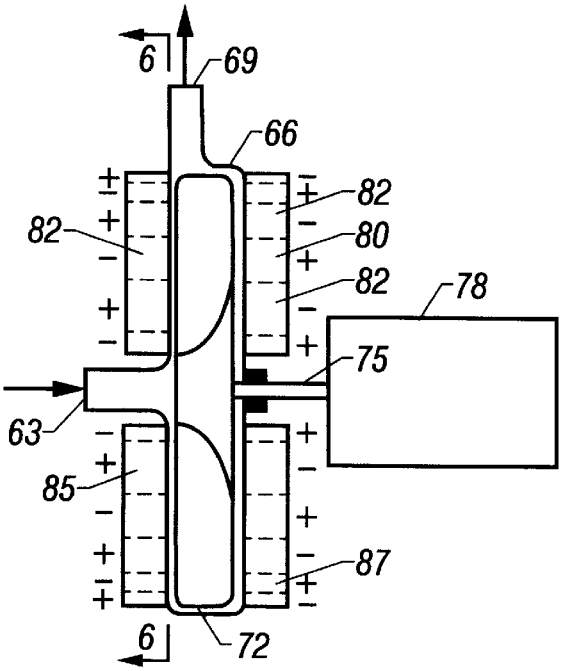
FIG. 5 shows a partial sectional plan view of a pumping and heating apparatus, according to one embodiment of the present invention.
Figure 6:
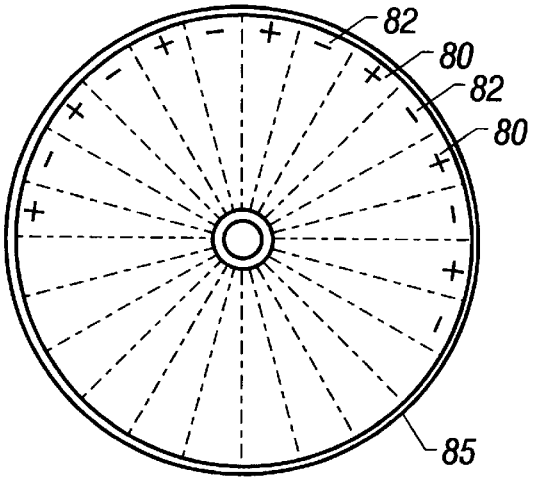
FIG. 6 shows a face of a disc containing magnets, as seen along the lines 6—6 of FIG. 5.

FIGS. 5 and 6 show an alternative embodiment 60 of the heating apparatus of the present invention. A pumping and heating apparatus 60 has an inlet 63 to a centrifugal pump housing 66 and an outlet 69. An electrically-conductive impeller 72 is attached to a shaft 75 which is attached to and driven by a motor 78. As best seen in FIG. 5, permanent magnets 80 and 82 are secured between opposing faces of the pump housing 66 and the plates 85, 87. As can be seen in FIG. 6, the magnets 80 and 82 are triangularly shaped and arranged spoke-like so that adjacent magnets have opposing poles. Thus, a magnet 80 having a north (+) pole has magnets 82 on each side, which have a south pole (−). The magnets 80 and 82 are arranged so that a magnet 80 on plate 85 is opposite a magnet 82 on plate 87. Thus, a magnetic field is established through the pump impeller 72.

The impeller 72 is rotated by a motor, such as shown in FIG. 1, preferably between 1,000 to 3,000 rpm. When the impeller 72 is rotated within the magnetic field established by the magnets 80 and 82 on opposing plates 85 and 87, eddy currents are formed in the electrically-conductive impeller 72. The eddy currents heat the impeller 72. Heat from the impeller 72 is transferred to a fluid which is moved by the impeller between an inlet 63 and an outlet 69.

The plates 85 and 87 are preferably made from a ferromagnetic steel alloy. The magnets 80 and 82 are permanent magnets having a high field strength. The pump housing 66 is made from a non-magnetic material, preferably a plastic, and surrounded by insulation to prevent heat loss to the atmosphere. The impeller 72 is preferably made from a material having high electrical conductivity and either diamagnetic or paramagnetic properties. Where corrosion is not a problem, copper or aluminum may be used for the impeller 72. If the fluid to be pumped and heated is corrosive, a corrosion-resistant metal alloy is used. Also, an electrically-conductive fluid can be used so that eddy currents are set up in the fluid for direct heating, which can be in addition to indirect heating by contact with the impeller 72 or even instead of heating with the impeller 72.

The distance between the magnets 80 and 82 on the plates 85 and 87 is made as small as practicable. Additionally the distance between the plates 85 and 87 from the housing is made as small as practicable. This is because the shorter these distances, the greater the magnetic field strength penetrating the impeller 72, and the greater the heat generation. Thus, the shape of the impeller 72 and pump housing 66 is axially thin and radially broad. In this preferred embodiment, two discs are secured on opposite sides of the pump housing 66. Alternatively, a single disc may be secured to one face of the pump housing. Alternatively, the magnets 80 and 82 may be mounted directly on one side or both the sides of the pump housing 66.

The present invention as illustrated in FIGS. 5 and 6 has applications where there is a combined need to pump and heat a fluid, such as in process applications and in building heating.

Figure 7:
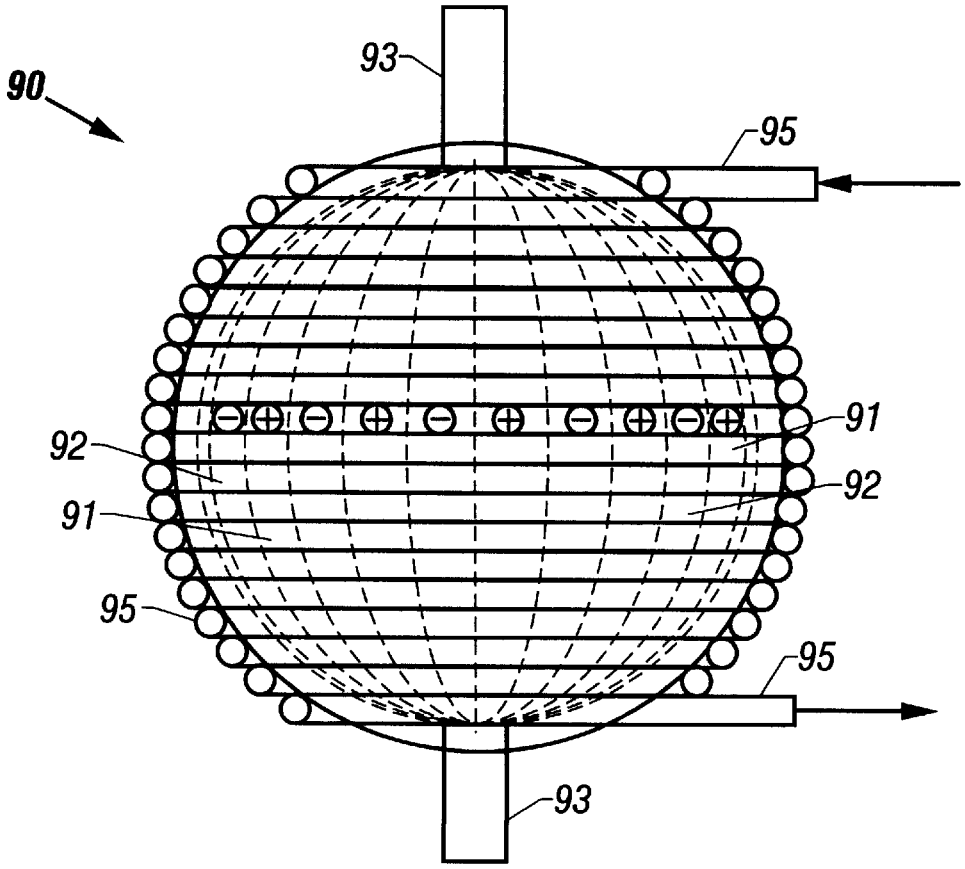
FIG. 7 shows an elevational view of an alternative embodiment of the heating apparatus of the present invention wherein the magnets are arranged around a sphere and the surrounded by a conducting coil.

With reference to FIG. 7, a heating apparatus 90 is shown containing a spherical magnet arrangement 91, 92 secured to a shaft 93. A conductor 95 surrounds the magnet arrangement 91, 92 and serves as a conduit for a fluid, which is to be heated. The magnet arrangement 91, 92 comprises alternating poses of north (+) 91 and south (−) 92 on the outer surface of the spherical magnet arrangement 91, 92. A driver (not shown) rotates the shaft 93 and the magnets 91, 92, which causes eddy currents to be generated in the conductor 95. The conductor 95 is heated by the eddy currents, and the heat is transferred to the fluid flowing within the conductor 95. The heating apparatus 90 may be constructed such that the magnets 91, 92 are within the fluid, but preferably the conductor 95 surrounds the magnets 91, 92 without placing the magnets 91, 92 in the fluid.

Figure 8:
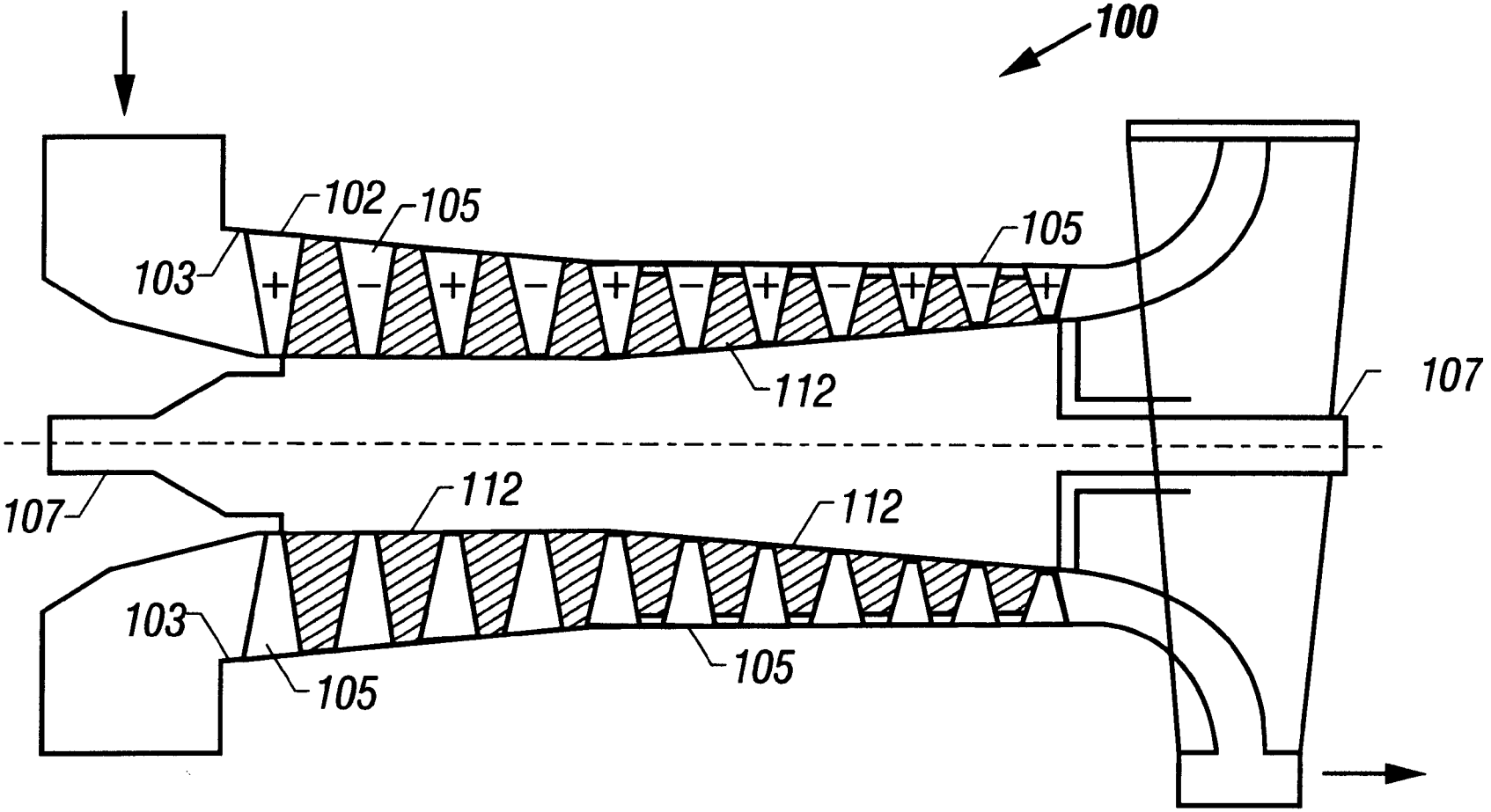
FIG. 8 shows a sectional side view of a heating and compressing apparatus according to one embodiment of the invention.

FIG. 8 shows a heating and compressing apparatus 100. A housing 102 provides a conduit for a fluid that is to be heated and compressed. The shell 102 has an inner surface 103 to which is attached a plurality of stators 105. A shaft 107 is aligned coaxially within the shell 102 and is rotated by a driver (not shown). Rotors 112 are secured to the shaft 107 in close proximity to the stators 105. The stators 105 are magnets, and the rotors are conductors. The stators 105 are arranged so that a north pose (+) is adjacent to a south pole (−) in an alternating fashion. In this manner a magnetic field is established through which the conductor rotors 112 rotate.

When the driver is activated, it rotates the shaft 107, which rotates the rotors 112. The stators 105 are stationary. As the rotors 112 rotate past the stators 105, eddy currents are formed in the rotors 112. The eddy currents heat the rotors 112, and that heat is transferred to the fluid flowing through the shell 102. The stators 105 and rotors 112 are shaped and arranged so that a compressible fluid is compressed as it flows through the heating and compressing apparatus 100. Thus, a fluid is heated by absorbing heat from the conductor rotors 112, which are heated by eddy currents during rotation past the stators 105, as well as compressed. Alternatively, the magnets may be placed on the rotor and the stators may be made from a suitable material for generating heat therein by eddy currents.

Figure 9:
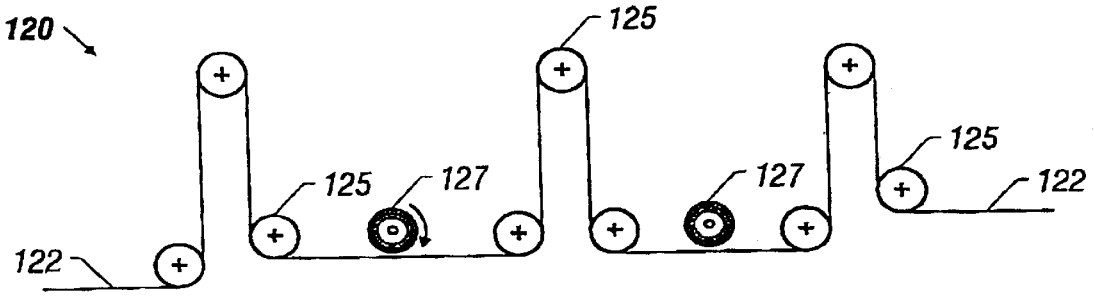
FIG. 9 shows a perspective view of a permanent magnet heating apparatus for a metal sheet according to one embodiment of the invention.

FIG. 9 shows a heating apparatus 120 for heating a sheet of material. For example, aluminum foil is made by rolling and stretching the metal into a thin sheet while the metal is hot. Permanent magnets are utilized to provide the heat. A metal sheet 122 is drawn and rolled by rollers 125. Magnets 127 are in close proximity, typically less than 100 millimeters and preferably less than 10 millimeters, to the metal sheet 122. The magnets 127 are rotated in counterflow to the movement of the metal sheet 122, so as to develop a high relative speed between the two. This relative motion sets up eddy currents in the metal sheet 122, which is electrically conductive and diamagnetic or paramagnetic. Alternative magnet configurations and arrangements to maintain the magnets 127 in close proximity to the work 122 to be heated are certainly possible.

Figure 10:
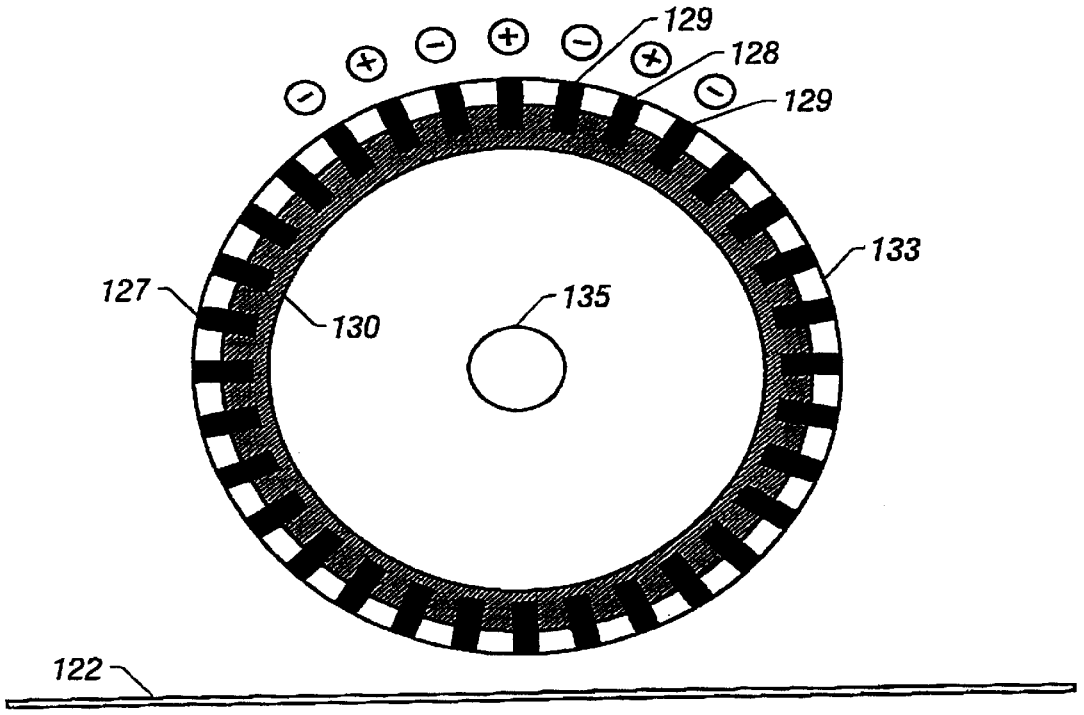
FIG. 10 shows an end view of a representative permanent magnet assembly as used in the apparatus of FIG. 9.

As shown in FIG. 10, the magnets 127 are fixed to a drum 130 and secured by a sleeve or fastening ring 133. The drum 130 is coaxially fixed to a shaft 135 by flanges (not shown). The radially outer surface of the magnets 127 have either a north (+) pole 128 or a south (−) pole 129. Adjacent magnets have opposite, attractive poles; thus, a magnet 128 has magnets 129 on each adjacent side. The distance between adjacent magnets 128, 129 is less than the radius from the center of the shaft 135 to the outer surface of the magnets 127. The distance between adjacent magnets 128, 129 is preferably less than 100 millimeters and more preferably less than 10 millimeters.

In principle, a linear or a combined linear relative motion could be produced between the magnets and the medium, along with the superimposed relative rotating motion. The permanent magnets could also be arranged stationary and the relative motion could be produced by the medium.

The range of uses of the above-described heating apparatuses does not restrict itself to the above-noted uses; rather, these heating apparatuses can be applied to various areas where heat energy is necessary. A few particularly suitable uses, for example, are refrigerators, climate control equipment, auto motors, high-pressure/high-temperature steam, chemical or medical devices.

The foregoing description is directed to particular embodiments and methods of the present invention for the purpose of illustration and explanation. It will be apparent, however, to one skilled in the art that many modifications and changes to the embodiments and methods set forth above are possible without departing from the scope and the spirit of the invention. It is intended that the following claims be interpreted to embrace all such modifications and changes.

What is claimed is:

1. A permanent magnet heating apparatus, comprising:

(a) a substantially non-magnetic heating element having
(i) a first side, and
(ii) a second opposing side, (b) a first rotating member carried on a shaft, the first rotating member placed adjacent the first side of the heating element, said first rotating member having at least one permanent magnet to produce eddy currents in the heating element when a relative motion is produced between the first rotating member and the heating element by rotation of said shaft; and (c) a second rotating member carried on said shaft, the second rotating member placed adjacent the second side of the heating element, said second rotating member having at least one permanent magnet to produce eddy currents in the heating element when a relative motion is produced between the second rotating member and the heating element by rotation of said shaft.

2. The heating apparatus as specified in claim 1, wherein each rotating member is a disc and the at least one permanent magnet comprises a plurality of magnets arranged around a circumference of such disc.

3. The heating apparatus as specified in claim 2, wherein the discs are rotated in unison, with the opposite polarity magnets on the discs facing each other.

4. The heating apparatus as specified in claim 2, wherein the heating element has a fluid flowing therein.

5. The heating apparatus as specified in claim 4, wherein the fluid is a conductive liquid.

6. A method of magnetically heating a fluid, comprising:

(a) passing the fluid through a substantially non-magnetic heating element;

(b) rotating a shaft carrying a first member and a second member, said first and second members carrying at least one permanent magnet each and disposed on opposite sides of and in proximity to the heating element; and (c) heating the heating element and the fluid therein by producing eddy currents in the heating element by the rotation of the first and second members.

7. The method as specified in claim 6, wherein the at least one magnet further comprises a plurality of magnets, and wherein:

each rotating member is a disc having the plurality of magnets disposed circumferentially thereon the magnets on the first rotating disc opposed to the magnets on the second rotating disc.

* * * * *